US010546442B2

(12) United States Patent
Matsuyama

(10) Patent No.: US 10,546,442 B2
(45) Date of Patent: Jan. 28, 2020

(54) AUTOMATIC OPENING/CLOSING DOOR

(71) Applicant: Toshiyasu Matsuyama, Matsusaka (JP)

(72) Inventor: Toshiyasu Matsuyama, Matsusaka (JP)

( * ) Notice: Subject to any disclaimer, the term of this patent is extended or adjusted under 35 U.S.C. 154(b) by 0 days.

(21) Appl. No.: 15/441,262

(22) Filed: Feb. 24, 2017

(65) Prior Publication Data

US 2018/0247474 A1 Aug. 30, 2018

(51) Int. Cl.
*G07C 9/00* (2006.01)

(52) U.S. Cl.
CPC ..... *G07C 9/00896* (2013.01)

(58) Field of Classification Search
None
See application file for complete search history.

(56) References Cited

U.S. PATENT DOCUMENTS 7,327,108 B2 * 2/2008 Mullet ..... G07C 9/00309 160/188
8,511,606 B1 * 8/2013 Lutke ..... B64C 39/028 244/100 R
9,056,676 B1 * 6/2015 Wang ..... B64F 1/00
9,387,928 B1 * 7/2016 Gentry ..... B64C 39/024
9,545,852 B2 * 1/2017 Streett ..... B64C 39/024

* cited by examiner

*Primary Examiner* — K. Wong
(74) *Attorney, Agent, or Firm* — Yokoi & Co., U.S.A.; Toshiyuki Yokoi

(57) ABSTRACT

An automatic opening/closing door 10 has an opening/closing portion 11 located at a lower side and a storage portion 12 located at an upper side. The opening/closing portion 11 has vertically arranged guide rails 14, 14 having a U-shaped cross section for guiding both ends of a roll-type shutter 13 in the width direction. The shutter 13 is slidable in the vertical direction without being detached from the guide rails 14, 14. When the shutter motor 15 is rotated in a predetermined direction, the shutter 13 located between the guide rails 14, 14 is wound up and the opening/closing portion 11 is opened. When the shutter motor 15 is rotated in a reverse direction, the shutter 13 is fed between the guide rails 14, 14 and the opening/closing portion 11 is closed. A controller 24 performs a predetermined guiding according to the approaching of the small-sized flying object.

6 Claims, 14 Drawing Sheets

Step 3 specification

Step 4 standby of identification code

Step 5 recognition of identification code

Step 6 shutter is opened to desired degree for predetermined time (images are taken by cameras)

Step 7 shutter is closed after predetermined time

Step 8 identification code is invalidated

AUTOMATIC OPENING/CLOSING DOOR

BACKGROUND OF THE INVENTION

1. Field of the Invention

The present invention relates to an automatic opening/closing door and a control method of the automatic opening/closing door. In particular, the present invention relates to the automatic opening/closing door and the control method of the automatic opening/closing door for a small-sized flying object.

2. Description of the Related Art

In recent years, an autonomous operation of the small-sized flying object is earnestly researched and developed. A transportation of a small-sized package is attempted by autonomously operating the small-sized flying object. The package is delivered to a garden. However, there is a risk of theft when the package is delivered to the garden.

In order to deliver the package into a house, it is considered that a person at home opens a door when the package is transferred or a general automatic door for human is used.

BRIEF SUMMARY OF THE INVENTION

In the method of opening the door by a person at home, the package cannot be transferred into the house if the person is absent when the package is transferred.

It is difficult for the automatic door for human to be opened/closed by recognizing the small-sized flying object. If the automatic door is specified to open in any situations, the door opens even for a suspicious person. In such a situation, there is a safety problem.

In the present invention, regardless of the presence/absence of the person at home, the door is opened/closed only when required to allow the small-sized flying object to enter into the house.

The present invention is an automatic opening/closing door having a predetermined openable opening to be opened to a desired degree, the door comprising: an identification code storage unit that stores a predetermined identification code; an identification code recognition unit that recognizes an identification code of a flying object; an identification code matching judgment unit that judges whether or not the stored identification code and the recognized identification code are matched; an opening control unit that controls to open/close the opening according to a judgment result; and a guide unit that guides the flying object to the opening.

In the above described configuration, the automatic opening/closing door can be installed on the predetermined opening, the opening can be opened/closed, and the opening can be opened to a desired degree. Furthermore, the identification code storage unit stores a predetermined identification code, and the identification code recognition unit recognizes an identification code of a flying object. Then, the identification code matching judgment unit judges whether or not the stored identification code and the recognized identification code are matched, and the opening control unit controls to open/close the opening according to a judgment result. In addition, the guide unit guides the flying object to the opening.

An automatically opening/closing window or door can be achieved so that an automatically-operatable flying object (unmanned aircraft) such as a drone is allowed to pass only when the identification code is authenticated. For example, the identification code is authenticated when the flying object has a preliminarily registered identification code (ID) or an identification code (ID) issued for each event.

As another embodiment of the present invention, the identification code includes a first identification code not depending on distance and a second identification code for short distance, and the identification code storage unit, the identification code recognition unit and the identification code matching judgment unit use both the first identification code and second identification code.

In the above described configuration, the first identification code is not depending on distance, and the second identification code is for short distance. In addition to the matching of the first identification code, the identification code storage unit, the identification code recognition unit and the identification code matching judgment unit use the second identification code to recognize the flying object after the flying object approaches within a short distance.

For example, a plurality of identification codes (IDs) such as the identification code (ID) confirmed at a short distance of the door (e.g., bar code, number plate, RF identification code) and the identification code (ID) confirmed electrically (e.g., wireless communication, optical communication) are used for the verification of the identification code (ID). By recognizing and verifying the plurality of identification codes (IDs) simultaneously, illegal use of the identification code is prevented. Thus, the verification of the identification code (ID) is enabled with high security.

As another embodiment of the present invention, the identification code includes a third identification code, and the identification code matching judgment unit judges the third identification code recognized by the identification code recognition unit to be matched with the stored identification code regardless of an actual matching of the stored identification code and the recognized identification code.

As an example of the operation, the identification code (ID) can be mainly categorized into the preliminarily registered identification code and the identification code issued for each event such as an order. The preliminarily registered identification code is given to a drone owned by the user himself/herself or a drone owned by the contracted service provider such as a hospital and a security company.

On the other hand, the flying object should be allowed to enter in some cases even when the identification code is not preliminarily registered. For example, a drone providing particular services such as electricity, water supply and gas supply, or a drone of public institutions such as a post office and a police station should be allowed to enter. Therefore, the third identification code is given to these drones. When the third identification is confirmed, the flying object is allowed to pass even if the identification code is not preliminarily registered.

As another embodiment of the present invention, the identification code includes an occasional identification code, and the identification code matching judgment unit has a clocking unit so that the occasional identification code is valid only when the occasional identification code is within a valid period based on a clocking result of the clocking unit.

In the above described configuration, when the identification code of the flying object is the occasional identification code, the identification code matching judgment unit judges whether or not a valid period has elapsed based on the clocking result of the clocking unit. Thus, only the occasional identification code within the valid period is validated. Accordingly, about the occasional identification code, the stored identification code and the recognized identification code are not judged to be matched if the valid period has already elapsed.

The identification code (ID) issued for each event includes the identification code issued when delivering commercial goods or the like, for example. In this case, the identification code (ID) is preliminarily transferred from the ordering side when ordering the commercial goods, and the identification code (ID) is identified to open/close the door when the commercial goods is delivered.

On the contrary, the identification code (ID) can be also transferred from a store or a delivery company by an e-mail or the like before the delivery, and the transferred identification code (ID) is identified to open/close the door. If the identification code (ID) is issued for each event, security is improved by limiting the valid period of the identification code (ID) to a predetermined period (e.g., within one week from the order date).

The position of the door itself and the opening can be indicated by a plurality of optical beacons for enabling the autonomously flying drone to enter in the opening easily. Thus, the drone is guided to enter in and leave from the opening safely so that the drone itself is not damaged and surroundings are not damaged by the drone. In this case, it is not preferable to allow a plurality of drones to enter in the opening simultaneously. It is preferable to specify a priority order so that each drone can enter in the opening safely and surely.

As another embodiment of the present invention, a standby instruction unit that instructs the flying object to stand by and a priority judgment unit that identifies a priority order of a plurality of flying objects are further provided, and the standby instruction unit instructs the plurality of flying objects to stand by except for the flying object having a highest priority order according to an identification result of the priority judgment unit, and the guide unit guides the flying object having the highest priority order.

In the above described configuration, the standby instruction unit can instruct the plurality of flying objects to stand by, and the priority judgment unit can identify the priority order of the plurality of flying objects. When the plurality of flying objects arrive simultaneously, the standby instruction unit instructs the plurality of flying objects to stand by except for the flying object having the highest priority order according to the identification result of the priority judgment unit, and the guide unit guides the flying object having the highest priority order.

In addition, it is preferred that the position of the drone is recognized by a camera, a sensor or the like mounted on the door to feed back the information to the drone side through a communication. Thus, the drone can pass through the opening more correctly and safely. Furthermore, colored light, pulsed light or the like can be used for the optical beacons so that the optical beacons are clearly distinguished from sunlight and surrounding illumination. Thus, the optical beacons can be easily recognized by the drone.

As another embodiment of the present invention, the guide unit has a light guide unit having a plurality of light emitting elements, the light guide unit provides a positional information to the flying object by controlling independently the plurality of light emitting elements in a proximity mode, and the light guide unit provides the positional information by integrally controlling the plurality of light emitting elements in a far distance mode.

In the above described configuration, the guide unit has a light guide unit having a plurality of light emitting elements. The light guide unit changes the method of providing the positional information between the proximity mode and the far distance mode.

In the far distance mode, a plurality of light emitting elements is controlled integrally to provide the positional information of the door. Thus, the light emitting elements can be confirmed from the longer distance than the case of transmitting the light signal by the individual light emitting element. In the proximity mode, on the contrary, by controlling a plurality of light emitting elements individually, the positional information can be provided to the flying object in a state that the positional information is increased by the difference of the mounting position of the light emitting elements themselves.

For example, the optical beacons for guiding have a plurality of modes. When the drones are not existed at a short distance, all the optical beacons are blinked at the same timing to guide the drones located at a long distance. Because of this, the optical beacons can be easily seen from the long distance. When the drone approaches to the window or the door, the mode is switched to a guide mode, and the lighting method is changed so that the position of the window or the door can be surely distinguished.

Note that the infrared or other wavelengths that cannot be seen by the human eye but can be recognized by the drone are preferably used if light pollution is assumed when using the light outdoor.

In the present invention, regardless of the presence/absence of the person at home, the door is opened/closed only when required to allow the small-sized flying object to enter into the house.

DETAILED DESCRIPTION OF THE INVENTION

Hereafter, embodiments of the present invention will be explained based on the drawings.

Figure 1:
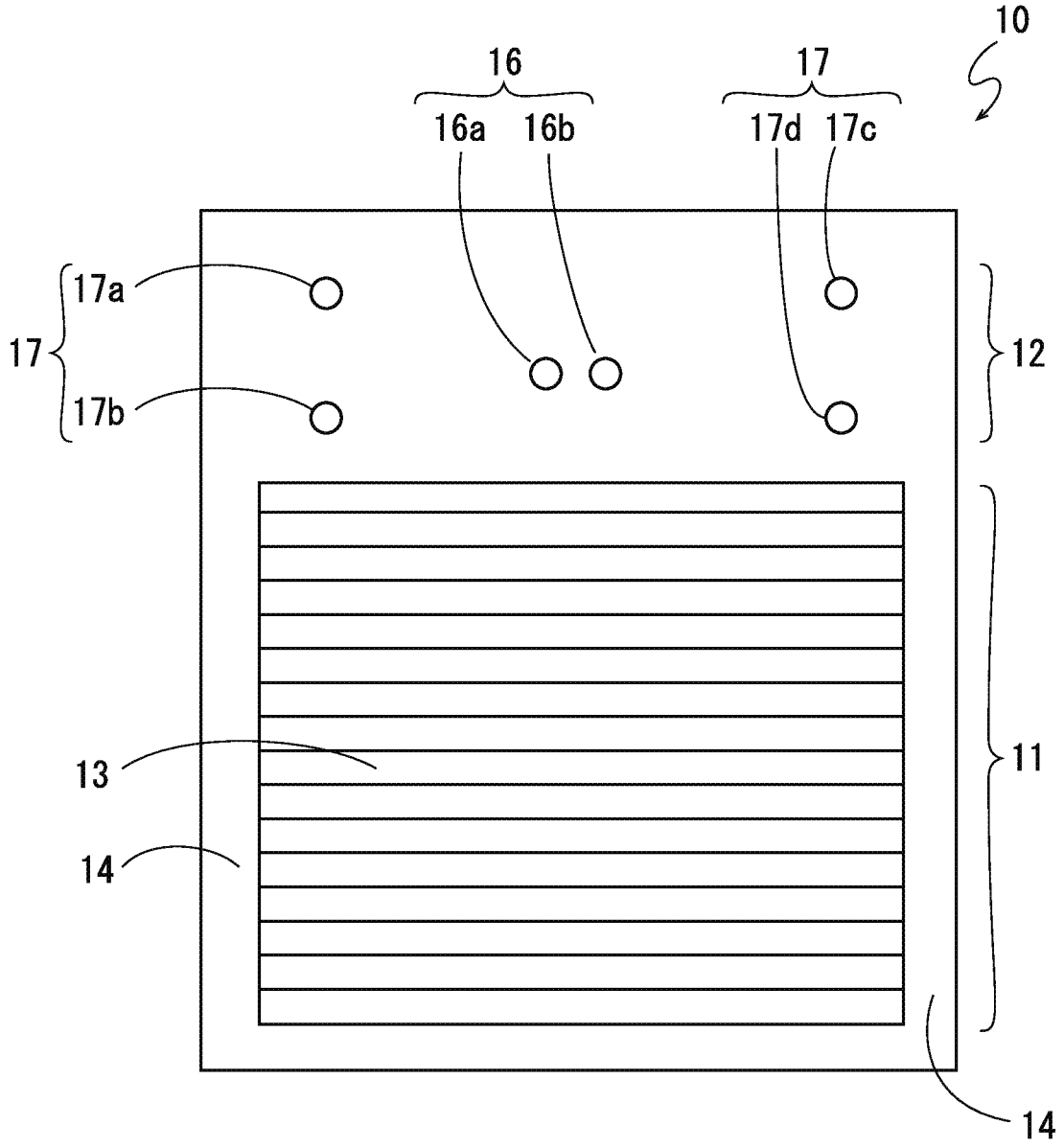
FIG. 1 is a front view of an automatic opening/closing door concerning an embodiment of the present invention.
Figure 2:
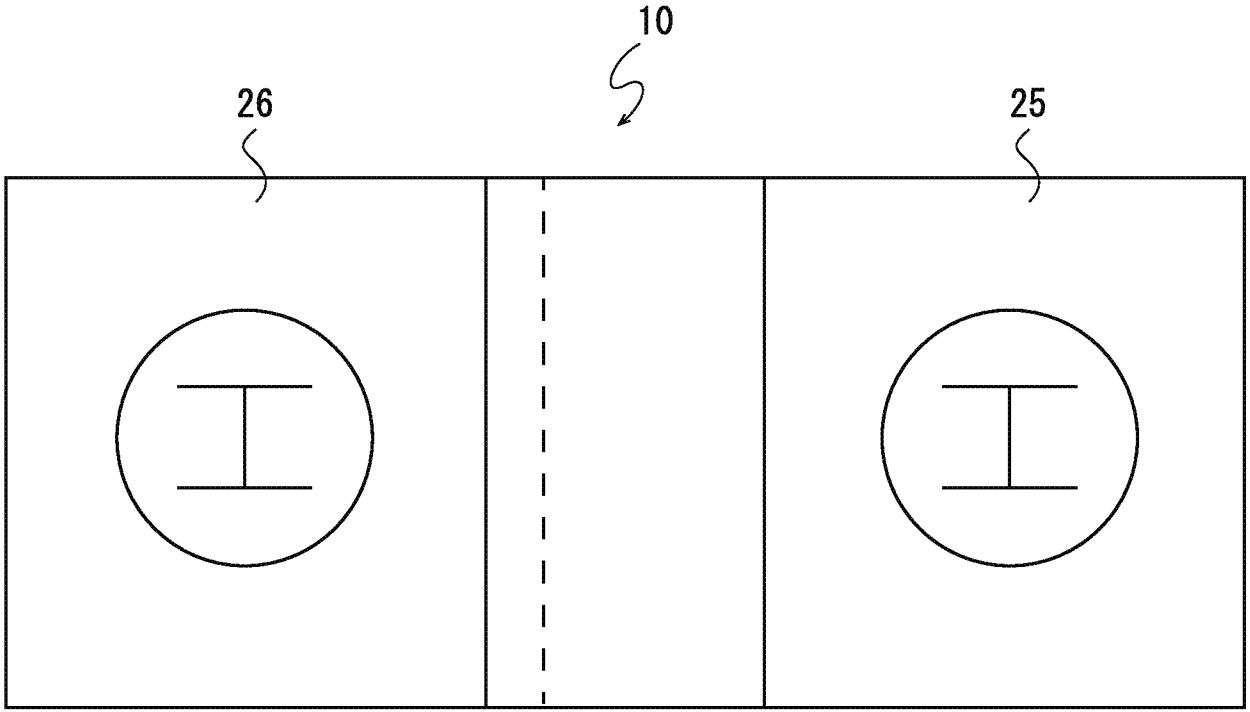
FIG. 2 is a plan view of the automatic opening/closing door.
Figure 3:
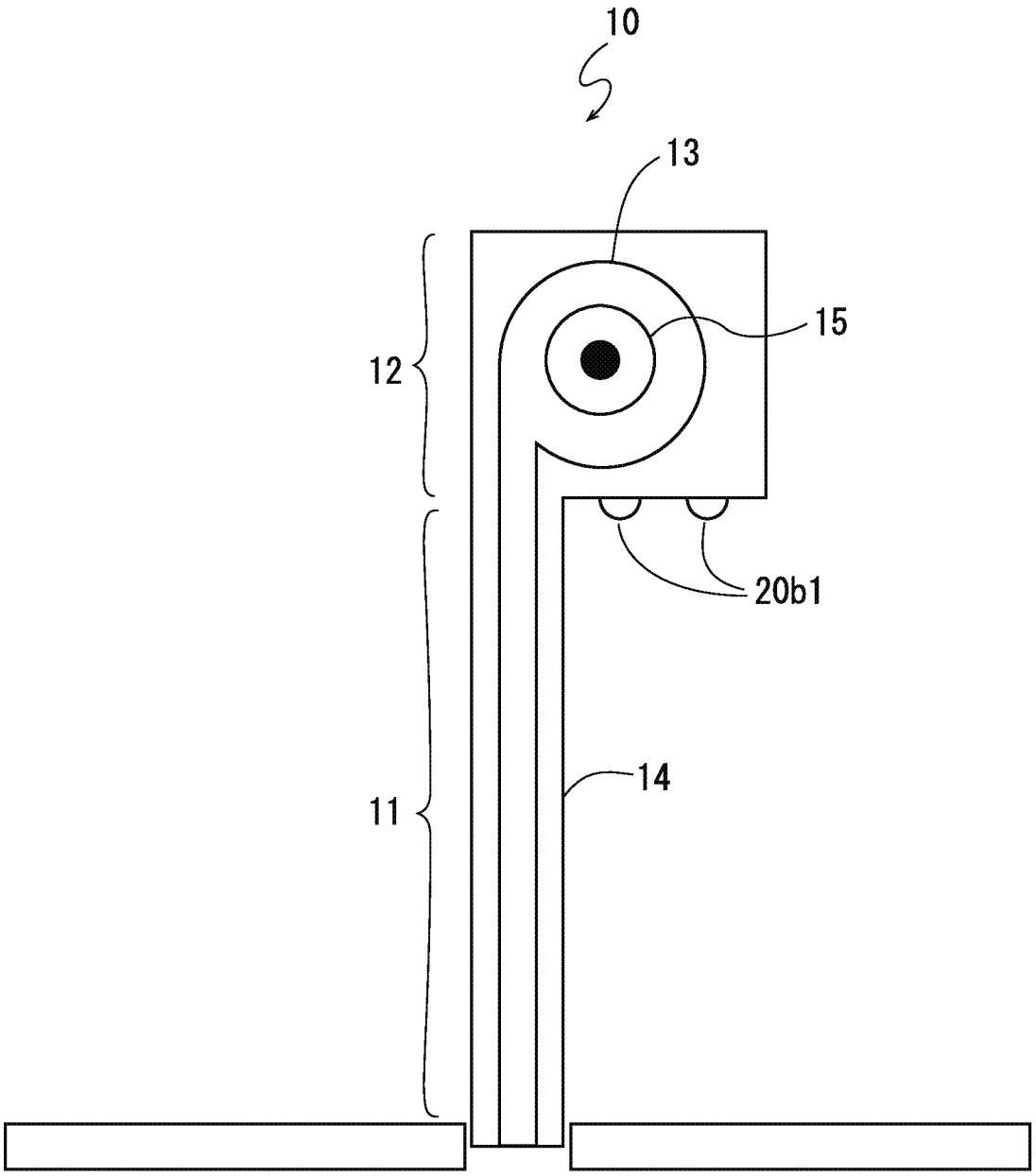
FIG. 3 is a lateral cross-sectional view of the automatic opening/closing door.

The automatic opening/closing door concerning an embodiment of the present invention is shown as a front view in FIG. 1, as a plan view in FIG. 2, and as a lateral cross-sectional view in FIG. 3.

In the figures, the automatic opening/closing door (or automatic door) 10 has an opening/closing portion 11 located at a lower side and a storage portion 12 located at an upper side. The opening/closing portion 11 has vertically arranged guide rails 14, 14 having a U-shaped cross section for guiding both ends of a roll-type shutter 13 in the width direction. The guide rails 14, 14 are arranged so that openings face each other. The length of the shutter 13 in the width direction is matched with the guide rails 14, 14 so that the shutter 13 is slidable in the vertical direction without being detached from the guide rails 14, 14. The storage portion 12 has a hollow space to house the shutter 13 in a state that the shutter 13 is wound. A shutter motor 15 of the shutter 13 is also housed. When the shutter motor 15 is rotated in a predetermined direction, the shutter 13 located between the guide rails 14, 14 is wound up and the opening/closing portion 11 is opened. When the shutter motor 15 is rotated in a reverse direction, the shutter 13 is fed between the guide rails 14, 14 and the opening/closing portion 11 is closed. The degree of an opening can be arbitrarily adjusted by the rotational amount of the shutter motor 15.

The opening opened/closed by the shutter 13 corresponds to the predetermined openable opening. The opening can be opened/closed by the shutter motor 15 and the shutter 13. In addition, the opening can be opened to a desired degree.

Although the wind-up type shutter 13 is used for the opening/closing portion 11 in the present embodiment, various mechanisms can be adopted instead. For example, a plurality of aperture blades can be annularly arranged like a diaphragm of the camera, or a part of the window or the door can be simply moved upward/downward.

The automatic opening/closing door 10 is assumed to be attached to the window of the building, as an example. When the automatic opening/closing door 10 is directly attached to the opening of the window or attached via an adapter, the indoor and outdoor can be communicated or blocked by opening/closing the opening/closing portion 11. The small-sized flying object (hereinafter simply referred to as drone) can be allowed/prohibited to enter the indoor by opening the opening/closing portion 11.

The storage portion 12 has cameras 16 (16*a*, 16*b*) and beacon emitters 17 (17*a*-17*d*) on an outer surface. The details of them will be explained later. Note that the cameras 16 (16*a*, 16*b*) and the beacon emitters 17 (17*a*-17*d*) can be also provided on the reverse surface in the similar position.

Figure 4:
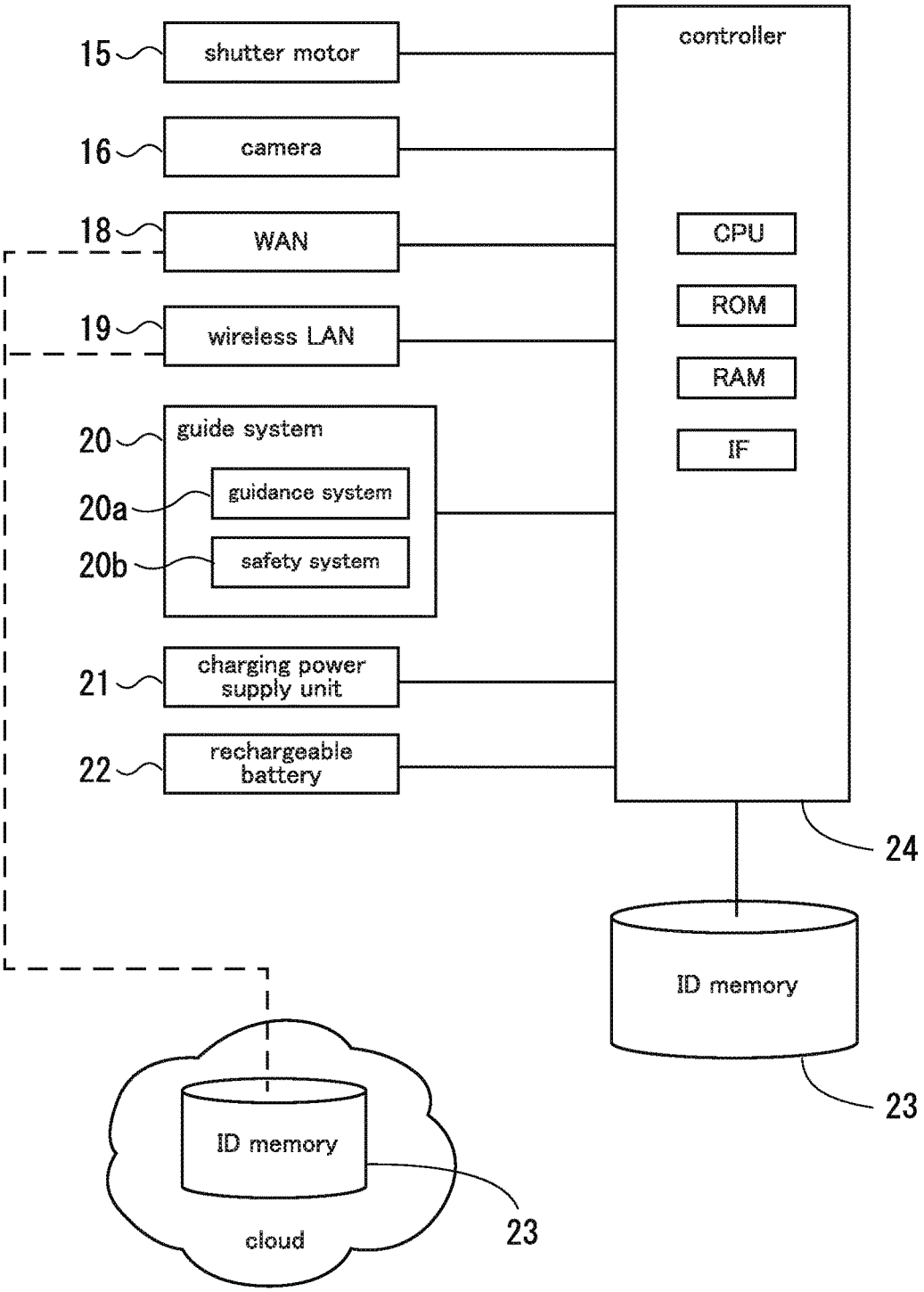
FIG. 4 is a block diagram showing an approximate configuration of the automatic opening/closing door.

FIG. 4 shows an approximate configuration of the automatic opening/closing door as a block diagram.

As described above, the automatic opening/closing door 10 has the shutter motor 15, the cameras 16 (16*a*, 16*b*) and the beacon emitters 17 (17*a*-17*d*) as a configuration. Furthermore, a WAN 18 connectable to the Internet, a wireless LAN 19 for connecting to a network within a predetermined small area, a guide system 20, a charging power supply unit 21, a rechargeable battery 22, a controller 24 and an ID memory 23 for storing the identification code (ID) are provided, for example. The guide system 20 has a guidance system 20*a* and a safety system 20*b*. The guidance system 20*a* includes the beacon emitters 17. In this example, beacon signals use the light signal emitted by the beacon emitters 17. However, radio waves can be used instead. In addition, when the small-sized flying object approaches to the shutter on the indoor side, the shutter 13 can be opened without any conditions.

Furthermore, the second identification code can be used when the small-sized flying object comes out from the indoor to the outdoor.

The WAN 18 is connected to a wide area network such as the Internet via a wired network in the building to which the automatic opening/closing door 10 is attached. A wireless network can be used instead. The wireless LAN 19 is used mainly for exchanging information with the small-sized flying object. As an example, an SSID which is commonly recognized by both sides is specified. Because of this, a predetermined control can be performed only when the small-sized flying object is connected with the network in a state that the small-sized flying object is actually flying near the automatic opening/closing door 10.

The guide system 20 has the guidance system 20*a*. The guidance system 20*a* guides a landing of the small-sized flying object by using the beacon emitters 17 (17*a*-17*d*). The beacon emitters 17 (17*a*-17*d*) have four groups of light emitting elements (17*a*-17*d*). As shown in FIG. 1, the light emitting elements are arranged to be separated by a predetermined distance from each other. The guidance system 20*a* guides the small-sized flying object by using the far distance beacon mode so that the small-sized flying object can find the automatic opening/closing door 10 from a distance and approach to it and using the proximity beacon mode so that the small-sized flying object can recognize the automatic opening/closing door 10 for landing after the small-sized flying object approaches nearer to the automatic opening/closing door 10. In the far distance mode, the guidance system 20*a* makes the four groups of light emitting elements (17*a*-17*d*) blink integrally since high emission intensity is needed to be seen from a distance. Because of this, the emission intensity becomes four times higher than the case of individually blinked. Thus, the light emitting elements can be easily found even from a distance. Of course, a predetermined identification code (ID) is indicated by the blink. The small-sized flying object decrypts the identification code (ID) from an interval of the blink. Then, the small-sized flying object judges whether or not the blinking automatic opening/closing door 10 is a destination of the small-sized flying object, and uses the blink as a guide to approach to the automatic opening/closing door 10.

In the proximity mode, on the contrary, the guidance system 20*a* makes the four groups of light emitting elements (17*a*-17*d*) blink individually. When the small-sized flying object approaches enough to the automatic opening/closing door 10, the blink of the light emitting elements (17*a*-17*d*) can be distinguished enough even by the emission intensity of the individual light emitting elements (17*a*-17*d*). In the above described state, the light emitting elements (17*a*-17*d*) are individually controlled and blinked so that the small-sized flying object distinguishes the individual position of the light emitting elements (17*a*-17*d*). Because of this, a rectangular plane formed by four points is identified. From a degree of distortion of the rectangular shape, the small-sized flying object can calculate and identify a relative position with respect to the automatic opening/closing door 10. Based on the calculation result, the small-sized flying object is autonomously operated to approach to and land on the automatic opening/closing door 10 according to the preliminarily determined approach pass, or take off and separate from the automatic opening/closing door 10.

The guidance system 20*a* corresponds to the guide unit. The light emitting elements (17*a*-17*d*) correspond to the light guide unit having a plurality of light emitting elements. As explained above, the light guide unit provides the positional information to the flying object by controlling independently the plurality of light emitting elements in the proximity mode, and the light guide unit provides the positional information by integrally controlling the plurality of light emitting elements in the far distance mode.

The safety system 20*b* has a light sensor group 20*b*1 which is different from the light emitting elements (17*a*-17*d*). The position of the small-sized flying object is detected at the side of the automatic opening/closing door 10 by using the light sensor group 20*b*1. Then, a guide signal is transmitted so that the small-sized flying object can move to the indoor side safely. The guide signal can be transmitted and received via the wireless LAN 19. Therefore, the safety system 20*b* also corresponds to the guide unit. The light sensor group 20*b*1 can be arranged on the front surface side of the storage portion 12 and also on the reverse surface side. Because of this, the light sensor group 20*b*1 can easily function as the guide unit of the indoor side. Note that the guide unit is not limited to the unit using light. In addition to the light, radio wave and sound wave can be also used.

The charging power supply unit 21 supplies power so that the small-sized flying object can be charged at a landing pad 25 located in front of the automatic opening/closing door 10. The power for charging is supplied on the landing pad 25 only when the allowed small-sized flying object is landed after a predetermined communication is established. Note that the landing pad 25 is installed on the indoor side of the automatic opening/closing door 10.

As described later, the ID memory 23 stores the preliminarily and arbitrarily registered ID, the occasionally (temporarily) registered ID, the ID provided to the drone having high publicity as needed, and the ID detected only when the drone is approached. Note that the ID corresponds to the identification code. The ID memory 23 corresponds to the identification code storage unit for storing the predetermined identification codes. In addition to the above described identification codes, the ID memory 23 also stores the valid period when the valid period is specified. In addition to the use of the locally equipped storage element, the above described ID memory 23 can read/write the information stored in cloud memories connected via the WAN and the wireless LAN.

The controller 24 performs the later described various controls by executing predetermined programs. Therefore, the controller 24 internally has a CPU, a ROM, a RAM and an interface (IF) to constitute a computer.

Figure 5:
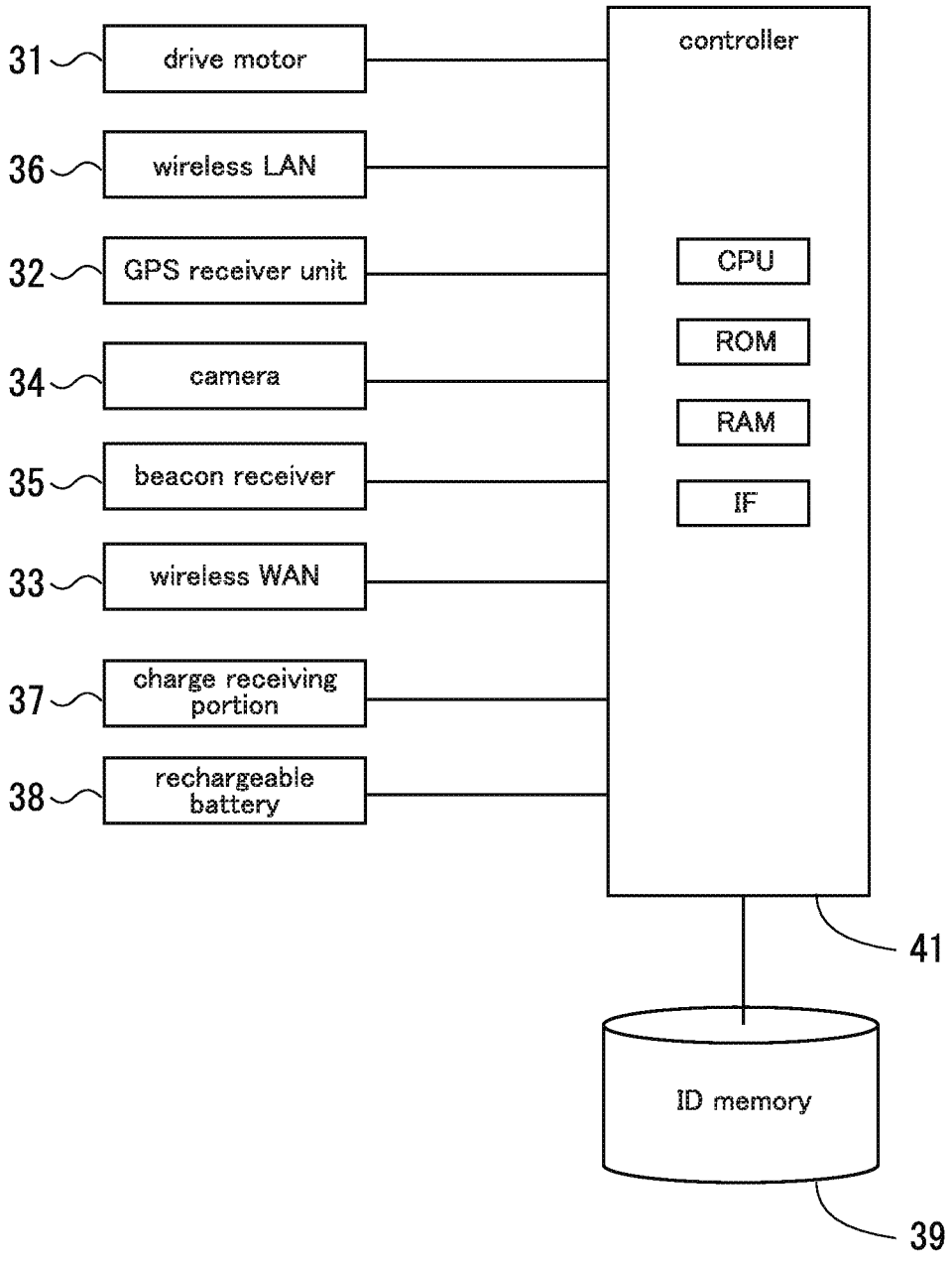
FIG. 5 is a block diagram showing an approximate configuration of an example of a small-sized flying object.

FIG. 5 shows an approximate configuration of an example of the small-sized flying object as a block diagram.

Although the small-sized flying object includes various types, the small-sized flying objects capable of flying autonomously to the predetermined target place and capable of connecting to wide area and local area network are assumed in the present invention.

As shown in the figure, the small-sized flying object has a drive motor 31 for flying autonomously, a GPS receiver unit 32 for obtaining the positional information, a wireless WAN 33 for connecting to the wide area network, a camera 34 for obtaining surrounding images, a beacon receiver 35 for receiving the light signal of the beacon emitters, a wireless LAN 36 for connecting to the local area network, a charge receiving portion 37, a rechargeable battery 38, an ID memory 39 for storing the identification code (ID), and a controller 41 for controlling the above described components.

The autonomous flight is enabled by using, the drive motor 31, the GPS receiver unit 32 and other components. Note that the flight is performed by, for example, controlling the attitude using a not illustrated gyro sensor or the like.

The camera 34 can be used for various purposes. As an example, the camera 34 can be used for photographing an outer appearance of the automatic opening/closing door 10 and the light emitting elements (17*a*-17*d*) to recognize them as an image and use them for identifying the relative position. Both the wireless WAN 33 and the wireless LAN 36 can communicate with the automatic opening/closing door 10 via the network. The communication of the wireless WAN 33 can be done regardless of the distance. On the other hand, the communication of the wireless LAN 36 can be done only in a relatively narrow area. Therefore, the first identification code not depending on distance is used in the identification of the wireless WAN 33, and the second identification code for short distance is used in the identification of the wireless LAN 36. Thus, different identification codes can be separately used.

Although the wireless LAN is used for the identification of the short distance, other identification methods can be used as long as the methods can be used only when the flying object approaches. For example, transmission/reception of infrared signal for short distance, communication using Bluetooth standard, and communication using RFID which is the communication standard for the closer state can be listed although they are merely examples of the available communication. In addition, an outer appearance can be also used for the identification. As an example for identifying the identification code, the specific small-sized flying object can be identified from the recognition of the outer appearance by photographing the approached small-sized flying object using the cameras 16 of the automatic opening/closing door 10. In this case, an individual two-dimensional bar code can be painted on the small-sized flying object to make the identification easier. In order to prevent the bar cord from being imitated by photographing the outer appearance, it is possible to attach a display on an outer surface of the small-sized flying object to display the occasional two-dimensional bar code issued depending on the situations.

The beacon receiver 35 obtains the predetermined positional information by receiving the above described light emitting elements (17*a*-17*d*) in both the far distance beacon mode and the proximity beacon mode. The beacon receiver 35 can be a simple light receiver or a method of using the photographing result of the moving object photographed by the camera 34.

The charge receiving portion 37 is used for receiving power for charging from the charging power supply unit 21 after the flying object is landed on the landing pad 25. The charge receiving portion 37 and the landing pad 25 can be conducted by connecting the electrodes with each other or conducted in a non-contact environment by using a magnetic field or the like.

The controller 41 performs the later described various controls by executing predetermined programs, similarly to the controller 24. Therefore, the controller 41 internally has a CPU, a ROM, a RAM and an interface (IF) to constitute a computer.

Figure 6:
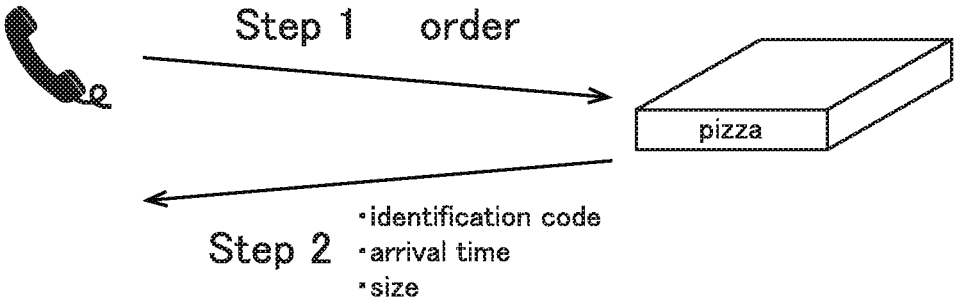
FIG. 6 is a drawing showing a process of receiving a delivery service using the small-sized flying object.

FIG. 6 shows a process of receiving a delivery service using the small-sized flying object.

As an example, a user orders a pizza shop to deliver a pizza in a state that the automatic opening/closing door 10 is installed at home. The small-sized flying object delivers a ready-cooked pizza to a predetermined position by passing through the automatic opening/closing door 10 of the user.

When the user orders a pizza (Step 1), the pizza shop identifies an identification code of the small-sized flying object, an arrival time and a size and informs them to the user side (Step 2). The above described information can be told orally or communicated via the network. For example, the user orders the pizza via the Internet, the above described information is transferred to the user with a confirmation of the order, and the information is stored in a predetermined server. The user obtains the information by himself/herself and specifies the obtained information on the automatic opening/closing door 10 (Step 3). Alternatively, the information can be obtained and specified by automatically referring to the server based on the confirmation of the order (Step 3). The identification code includes a first identification code for long distance and a second identification code for short distance.

The small-sized flying object is destined for the house of the user who orders the pizza by autonomous flight in a state that the ready-cooked pizza is loaded on the small-sized flying object. When the small-sized flying object approaches to the automatic opening/closing door 10, the first identification code not depending on distance is preliminarily communicated via the wireless WAN. Then, after the small-sized flying object approaches nearer to the automatic opening/closing door 10, the second identification code for short distance is communicated. For example, when the first identification code is received, the automatic opening/closing door 10 emits the beacon signal in the far distance beacon mode. On the other hand, when the second identification code is received, the automatic opening/closing door 10 emits the beacon signal in the proximity beacon mode. When the second identification code is not received, the beacon signal is not emitted in the proximity beacon mode. Because of this, although the small-sized flying object can approach to the automatic opening/closing door 10, the small-sized flying object cannot enter in the automatic opening/closing door 10 correctly. Thus, it is preferred from a viewpoint of security. The above described standby of the identification code corresponding to Step 4, and the recognition after the identification corresponds to Step 5. The identification code provided on the small-sized flying object is recognized by the automatic opening/closing door 10 side. Then, the automatic opening/closing door 10 judges whether or not the recognized identification code and the identification code stored in the automatic opening/closing door 10 side are matched.

When the identification codes are judged to be matched, the shutter 13 is opened to a desired degree for a predetermined time (Step 6). During the predetermined time, images are taken by the cameras 16. The images can be used as a proof of the delivery. After the predetermined time has elapsed, the shutter 13 is closed (Step 7). Then, the identification code issued and specified when ordering is invalidated (Step 8).

The control process of the controller 24 for achieving the above described steps will be explained.

Figure 7:
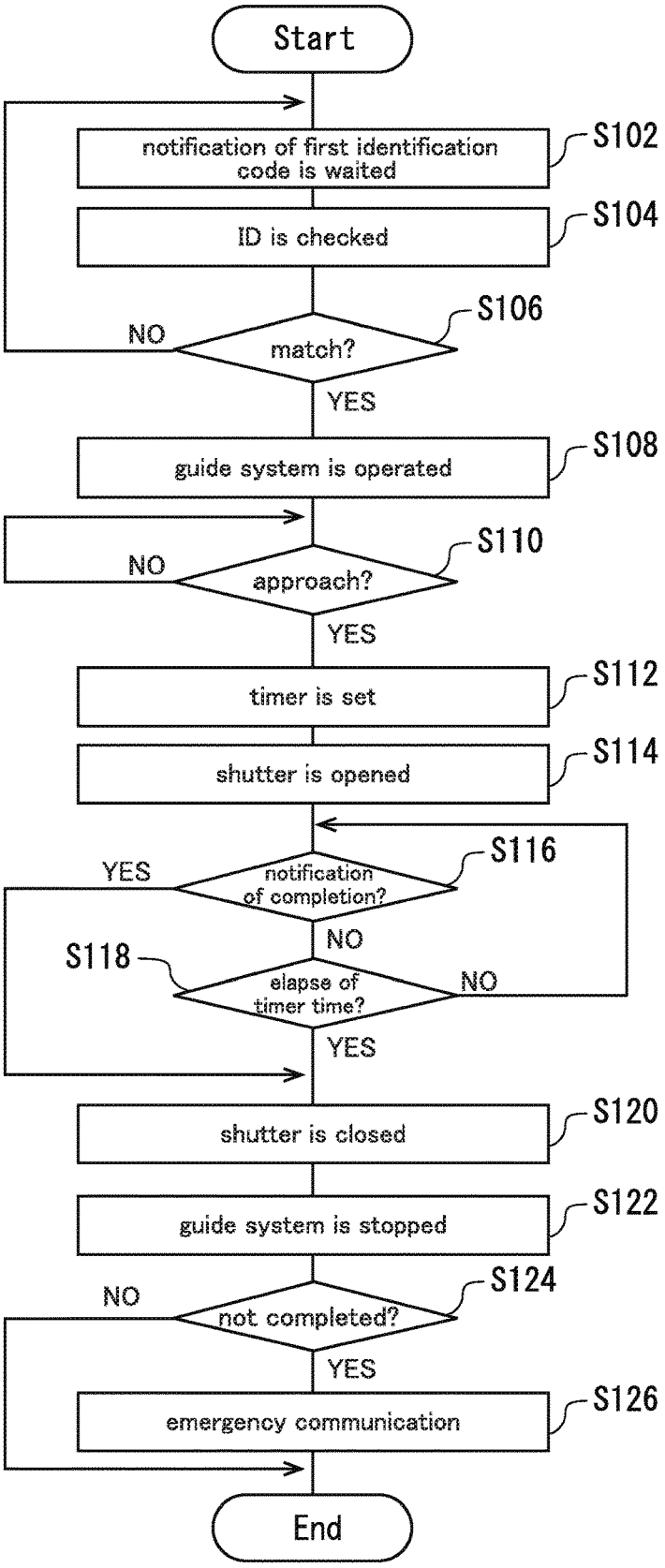
FIG. 7 is a flowchart showing a process of controlling the automatic opening/closing door.

FIG. 7 is a flowchart showing a process of controlling the automatic opening/closing door.

In Step S102, the controller 24 stores the identification code specified, for example, when the order is generated, and the controller 24 waits the notification of the predetermined first identification code notified from the small-sized flying object via the WAN 18. When the first identification code is notified from the small-sized flying object via the WAN 18, it is judged whether or not the first identification code is matched with the identification code stored in the ID memory 23 in Step S104. When the identification code is judged not to be matched in Step S106, the notification of the first identification code is waited again in Step S102. The identification code of the flying object is recognized and then whether or not the stored identification code and the recognized identification code are matched is judged by the processes of Step S104 and Step S106. These processes correspond to the identification code recognition unit and the identification code matching judgment unit about the first identification code not depending on distance.

Since the identification code not depending on distance is recognized, the guide system 20 is operated in Step S108. Since the guide system initially used is for long distance, the light emitting elements (17*a*-17*d*) of the guidance system 20*a* are driven in the far distance mode as described above. In other words, all of the light emitting elements (17*a*-17*d*) are integrally blinked so that the beacon signal is emitted to reach to far distances.

Although the small-sized flying object flies based on the positional information of autonomous flight, the small-sized flying object cannot exactly specify the window to which the automatic opening/closing door 10 is attached. Therefore, after approaching near to some extent, the small-sized flying object relies on the beacon signal of the far distance mode to approach nearer. In parallel, the communication of the wireless LAN is attempted using a wireless access point with a predetermined SSID. In Step S106, the automatic opening/closing door 10 side also judges that the small-sized flying object has approached when the communication of the wireless access point is established.

As described later, the identification codes within the valid period are stored in the ID memory 23. The automatic opening/closing door 10 can judge whether or not the identification code is within the valid period when the small-sized flying object is judged to approach in Step S106.

After that, the guide system 20 switches to the beacon signal of the proximity mode and the safety system 20*b* is operated. The safety system 20*b* monitors the movement of the small-sized flying object by the light sensor group 20*b*1 after the small-sized flying object approaches, and guides the small-sized flying object to move safely when entering the door.

The communication of the wireless LAN includes the communication of the second identification code. Namely, the small-sized flying object side transmits the second identification code when the predetermined SSIS is recognized, and the controller 24 side receives the second identification code via the communication of the wireless LAN 19 and confirms the matching with the identification code stored in the ID memory 23. Then, the small-sized flying object is judged to approach when the matching is confirmed. Accordingly, in the process of judging the approach in Step S110, the second identification code of the flying object is recognized and the matching between the stored second identification code and the recognized second identification code is judged. The above described processes correspond to the identification code recognition unit and the identification code matching judgment unit in the second identification code for short distance.

On the other hand, when the approach is confirmed, a clocking operation is started is Step S112 by setting a preliminarily assumed timer time. The timer time is a time required when the approached small-sized flying object passes through the automatic opening/closing door 10 to deliver the delivery goods in the room and then passes through the automatic opening/closing door 10 again to fly away. Of course, the time is specified to have a predetermined margin. As another specification, without specifying the above described time setting, the shutter 13 can be specified to close immediately after the small-sized flying object passes through the automatic opening/closing door 10 and enters in the room. In addition, the small-sized flying object can be specified to come out freely passing through the automatic opening/closing door 10.

Then, in Step S114, the controller 24 controls the shutter motor 15 to open the shutter 13 to a predetermined opening degree. The shutter motor 15 is driven to open the shutter 13 to the predetermined opening degree when the opening degree is specified, and to the maximum opening degree when the opening degree is not specified.

The small-sized flying object passes through the opening of the automatic opening/closing door 10 from the outside to the inside by using the guide of the safety system 20*b*. After delivering the package such as pizza to the predetermined position in the room, the small-sized flying object passes through the opening of the automatic opening/closing door 10 again from the inside to the outside and transmits the notification of completion using the wireless LAN 36. The coming out from the inside to the outside can be judged to be finished when the notification of completion is received after the above described guide is finished.

The controller 24 waits the notification of completion in Step S116 and waits the elapse of the timer time in Step S118. Normally, the notification of completion is received within the timer time. After the judgment of Step S116, the controller 24 drives the shutter motor 15 to close the shutter 13 in Step S120. At this point, the small-sized flying object should have already flied away to the outside. Therefore, the controller 24 stops the guide system 20 in Step S122. Then, the guide system 20 stops operation of the guidance system 20*a* in addition to the safety system 20*b*. After that, the small-sized flying object flies to its own departure point by autonomous flight.

As explained above, the processes of setting the timer time based on the judging result using the first identification code and the second identification code in Step S112 and opening/closing the shutter 13 until the timer time has elapsed in Step S114 and Step S120 correspond to the opening control unit that controls to open/close the opening according to the judgment result. In addition, the guide system 20 correspond to the guide unit that guides the flying object to the opening.

After the guide system 20 is stopped, the controller 24 judges whether or not the delivery is "not completed" in Step S124. As explained above, the notification of completion is received normally within the timer time. In such a case, the delivery is not determined to be "not completed" and all processes are finished.

However, if there are any troubles, the timer time has elapsed before receiving the notification of completion. In such a case, after the judgment of Step S118, the processes of Step S120 and later may start. In other words, the small-sized flying object is located in the room. Therefore, the controller 24 performs an emergency communication in Step S126 when the delivery is judged to be "not completed" in Step S124. For example, abnormal state can be notified to the sender of the small-sized flying object based on the information at the time when the identification code is given.

Of course, the guide system 20 can guide the small-sized flying object when passing through the door from the inside to the outside in addition to the outside to the inside. Basically, the guide system 20 can be functioned in both directions.

Figure 8:
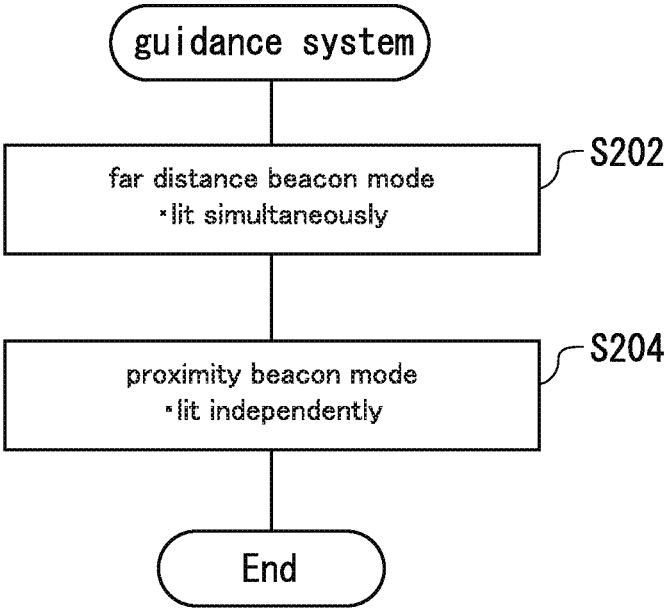
FIG. 8 is a flowchart showing a process of a guidance system.

FIG. 8 is a flowchart showing a process of the guidance system.

As described above, the guidance system has the far distance beacon mode and the proximity beacon mode. As shown in the figure, the guidance system 20*a* is initially in the far distance beacon mode in Step S202 so that the plurality of light emitting elements (17*a*-17*d*) are controlled to be lit simultaneously. Then, the mode is switched to the proximity beacon mode in Step S204 so that the plurality of light emitting elements (17*a*-17*d*) are controlled to be lit independently. The CPU of the controller 24 executes the program corresponding to the above described flowchart to control the hardware. Thus, the guidance system 20*a* is achieved.

Figure 9:
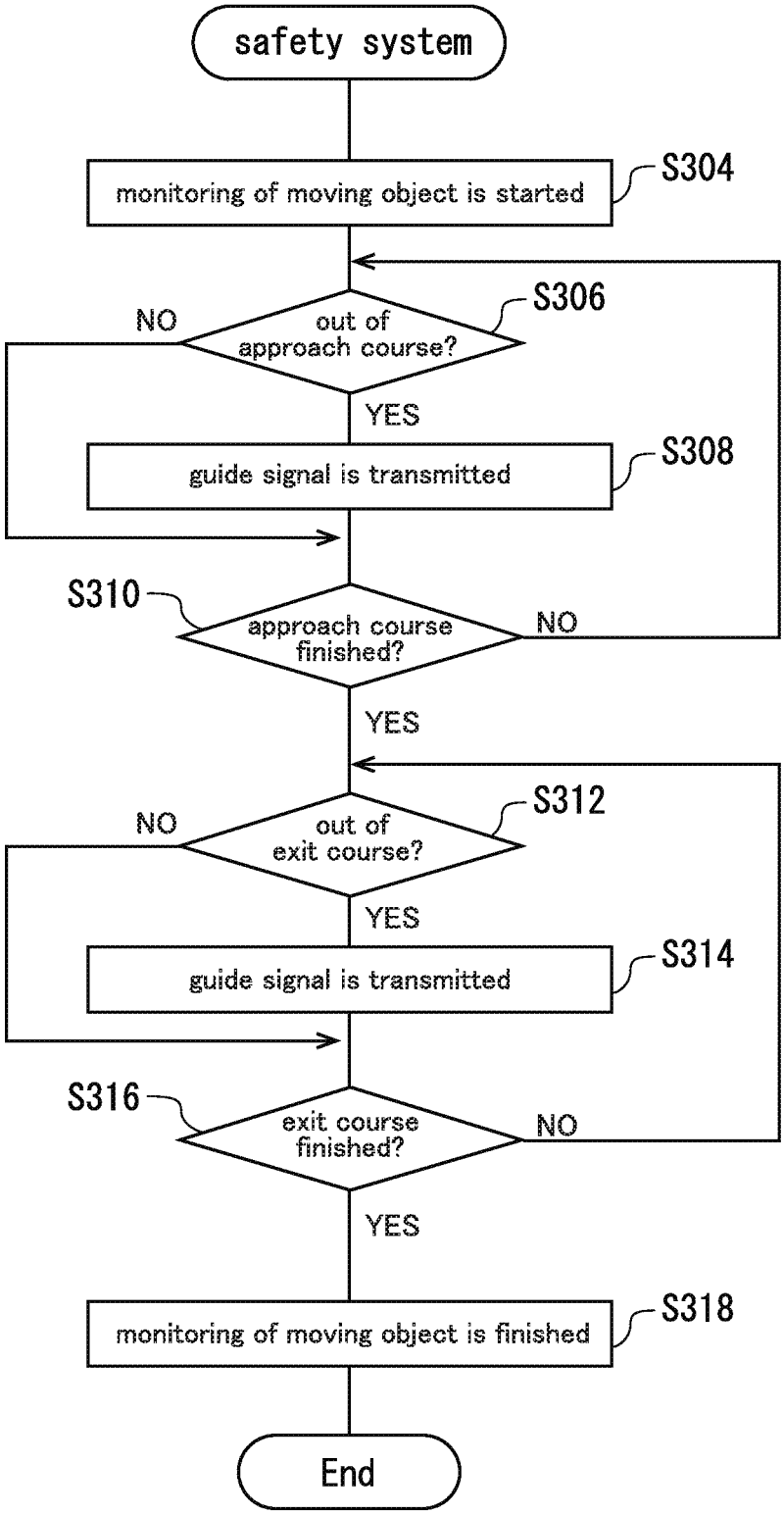
FIG. 9 is a flowchart showing a process of a safety system.

FIG. 9 is a flowchart showing a process of the safety system.

The safety system 20*b* detects the position of the small-sized flying object by the light sensor group 20*b*1 at the automatic opening/closing door 10 side and transmits the guide signal so that the flying object can move in the room side safely.

The guide signal is transmitted/received via the wireless LAN 19. In Step S304, the safety system 20*b* starts monitoring the moving object using the light sensor group 20*b*1. The flying route that the small-sized flying object passes through the opening the shutter 13 is preliminarily determined. In Step S306, it is judged that whether or not the flying object gets out of the approach course. When the flying object gets out of the approach course, the guide signal is transmitted in Step S308 to prevent the flying object getting out of the approach course. The flying is guided in Step S306 and Step S308 until the approach course is judged to be finished in Step S310.

After the approach course is finished, the flying object is made to fly along the exit course to return to the departure point. Therefore, while the monitoring of the moving object is continued, it is judged that whether or not the flying object gets out of the exit course in Step S312. When the flying object gets out of the exit course, the guide signal is transmitted in Step S314 to prevent the flying object getting out of the exit course. The flying is guided in Step S312 and Step S314 until the exit course is judged to be finished in Step S316.

After the exit course is finished, the monitoring of the moving object is finished in Step S318.

In rare cases, a plurality of autonomously flying drones may come.

Figure 10:
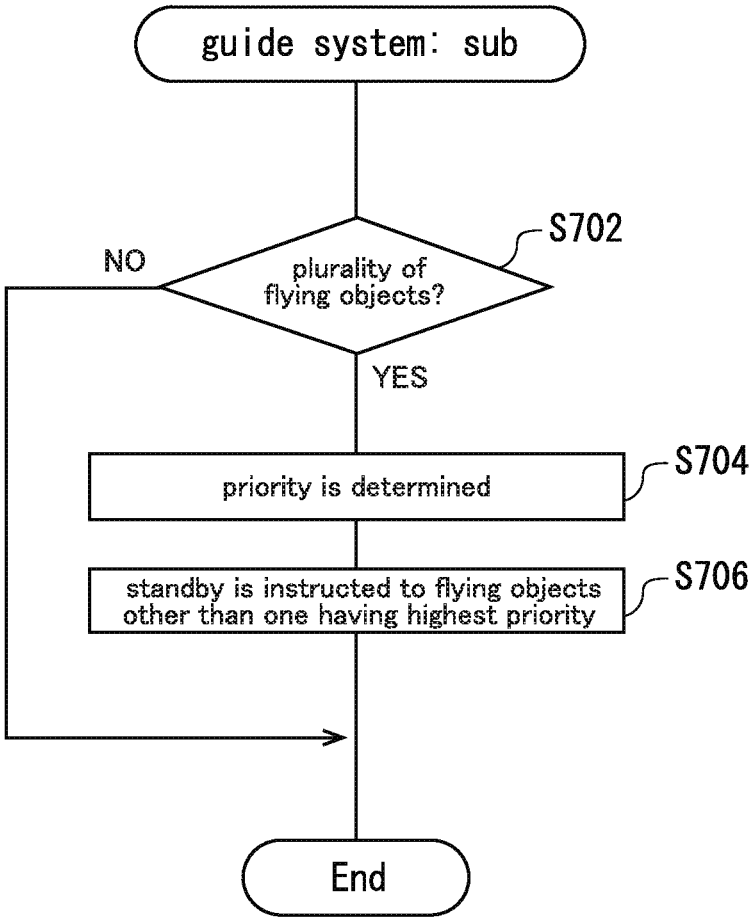
FIG. 10 is a flowchart showing a process of a guide system of a plurality of flying objects.

FIG. 10 is a flowchart showing a process of the guide system corresponding to a plurality of flying objects.

When the controller 24 judges that a plurality of flying objects are coming in Step S702, the controller 24 determines the priority order of each flying object in Step S704. Under normal circumstances, the priority order can be determined according to the order of coming. However, when the flying object with high emergency is flying, the highest priority order can be given to the flying object with high emergency. Then, the controller 24 instructs the flying objects other than the one having the highest priority order to stand by in Step S706.

In this case, the identification code of the flying object and the priority order are associated with each other and stored in the predetermined storage area. After the flying object having the highest priority order finishes the delivery or the like, the priority order is determined again in the flying objects which are instructed to stand by. The flying objects other than the one having the highest priority order are instructed to stand by again and the flying object having the highest priority order is guided by the guide system as described above.

In this case, colored light, pulsed light or the like can be used for the optical beacons to clearly distinguish the optical beacons from sunlight and surrounding illumination. Thus, the optical beacons can be easily recognized by the drone.

Figure 11:
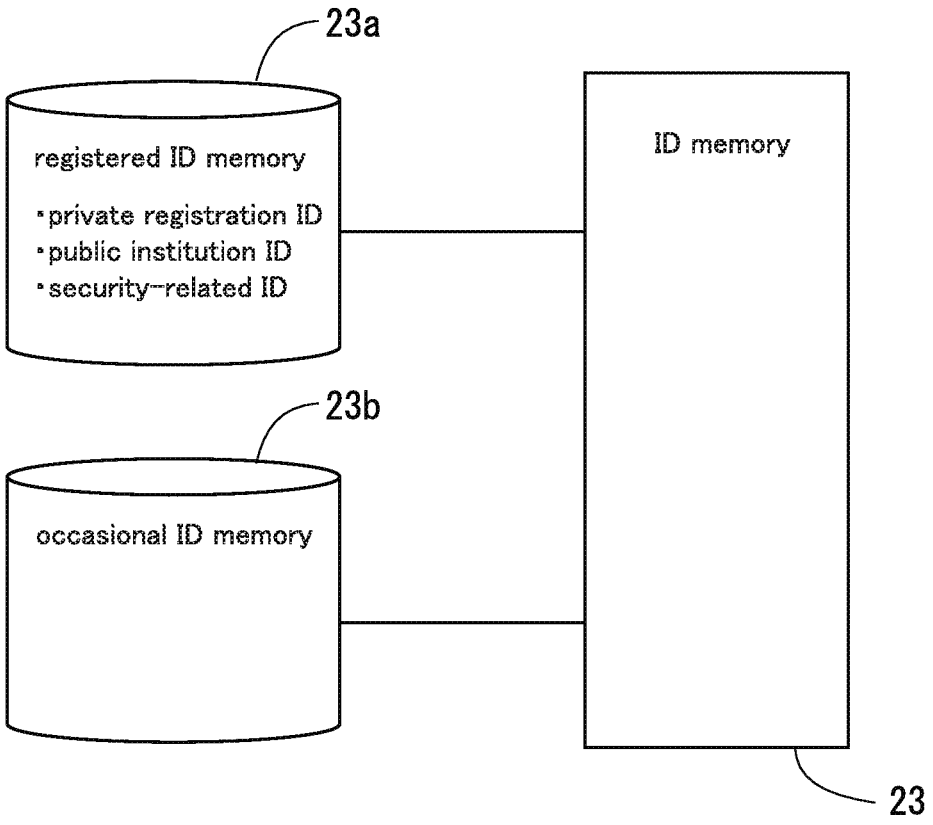
FIG. 11 is a drawing showing stored contents of an ID memory.

FIG. 11 is a drawing showing stored contents of the ID memory. Note that the ID means the identification code.

The ID memory 23 mainly includes a registered ID memory 23*a* and an occasional ID memory 23*b*. The identification code should be temporarily given and invalidated after the completion in some cases such as a delivery service. In such a case, the identification code is stored in the occasional ID memory 23*b* at a certain timing and deleted when the service is finished.

On the other hand, there are some identification codes to be used repeatedly by the user. The small-sized flying object owned by himself/herself is registered as a private registration ID. In addition, a police station and a fire station can be registered as a public institution ID. Thus, the shutter 13 can be allowed to open/close in an emergency. As a result of considering the emergency, a security-related private ID can be registered instead of the public ID.

As another specification of the public institution ID, the ID of the small-sized flying object can be treated as being belonged to the public institution only when the ID of the small-sized flying object is inquired to the public institution and the confirmation is obtained.

About the public institution ID, in addition to the method of preliminarily registering the ID, the shutter 13 can be specified to open/close even when the ID is not registered. Such an identification code is defined as the third identification code. About the third identification code, the identification code matching judgment unit judges the third identification code to be matched with the stored identification code regardless of an actual matching of the stored identification code and the recognized identification code.

Figure 12:
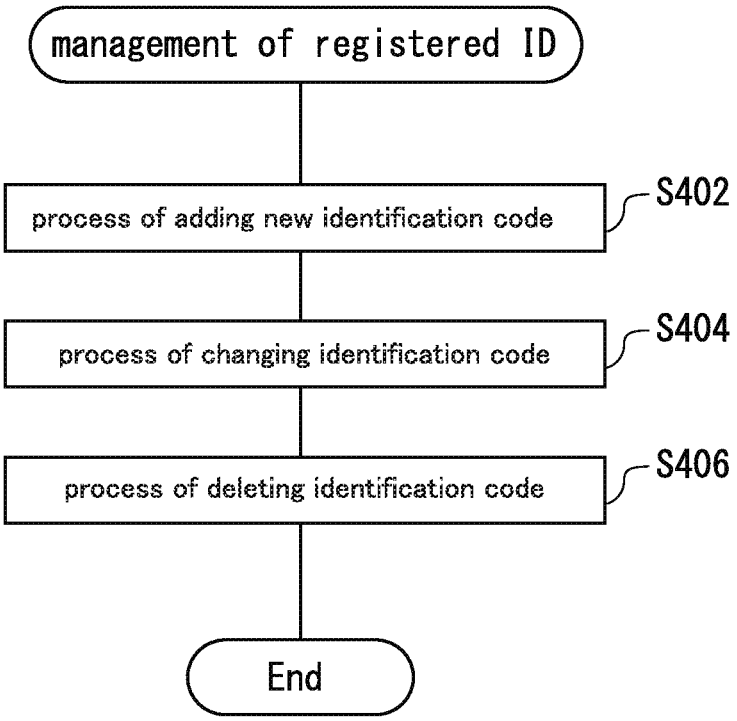
FIG. 12 is a flowchart showing a process of managing registered IDs for preliminarily registering the IDs in a registered ID memory.

FIG. 12 shows a process of managing registered IDs for preliminarily registering the ID in a registered ID memory as a flowchart.

About the identification codes preliminarily registered in the registered ID memory 23*a*, processes of adding, changing and deleting the identification codes are required.

The controller 24 performs the process of adding a new identification code in Step S402, performs the process of changing the registered identification code in Step S404, and performs the process of deleting unnecessary identification code from the registered identification codes in Step S406. Although the UI (user interface) of these processes is not exemplified, the controller 24 can display a menu to make the user select one of three processes. Thus, the selected process can be performed. In this case, even when a display or an operation panel are not provided on the automatic opening/closing door 10, the processes can be performed by accessing the controller 24 from a PC, a tablet or the like via a network.

Figure 13:
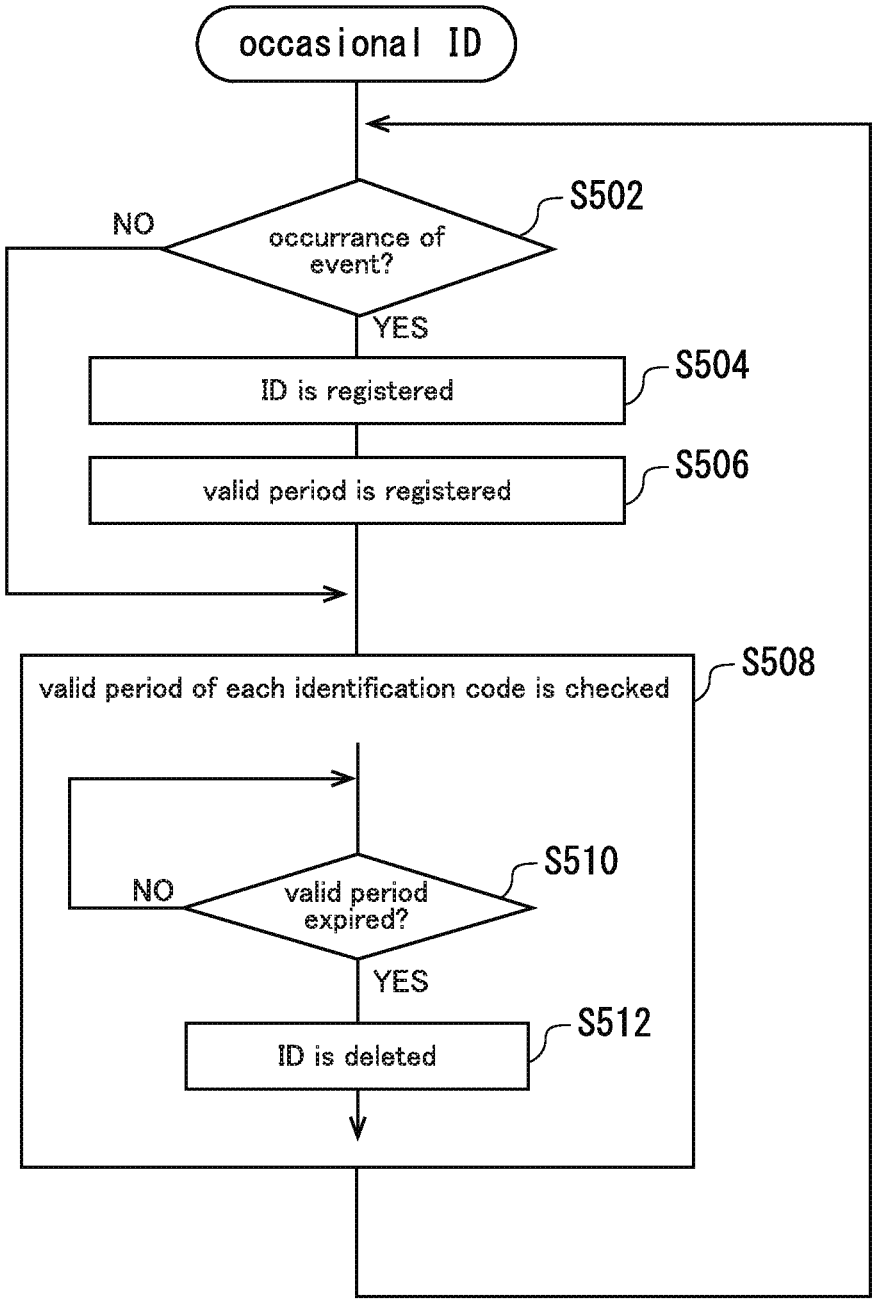
FIG. 13 is a flowchart showing a process of managing occasional IDs for temporarily registering the IDs in an occasional ID memory.

Then, FIG. 13 shows a process of managing occasional IDs for temporarily registering the IDs in an occasional ID memory as a flowchart.

The valid period is required for the occasional identification code. Since the valid period is specified, whether or not the occasional identification code is within the valid period at a predetermined timing.

The controller 24 monitors the occurrence or absence of the predetermined event in Step S502. When the event occurs, based on the notified identification code and the valid period, the identification code is registered in the occasional ID memory 23*b* in Step S504, and the valid period is registered in the occasional ID memory 23*b* in Step S506. The occurrence or absence of the event can be judged by whether or not the identification code and valid period are notified from the network. For example, when these are specified to be notified by electronic mail, a mail server is monitored periodically. Then, the received electronic mail is referred to obtain and specify the identification code and the valid period.

When the event does not occur, the valid period of each identification code is checked in Step S508 without specifying the above described settings.

Since a plurality of identification codes may be simultaneously registered as the occasional identification code, the following processes are performed independently for each ID. The controller 24 judges whether or not the valid period is expired for each ID in Step S510. The controller 24 has a clocking function. The controller 24 compares the current date and time and the valid period of each ID. If the valid period of the ID is expired, the ID is deleted together with the valid period in Step S512.

Since the controller 24 periodically repeats the processes of Steps S502 to S512, the identification codes stored in the occasional ID memory 23*b* are always within the valid period.

The user who allows the small-sized flying object to deliver and enter can provide convenience to other users. As an example, charging of the small-sized flying object can be allowed for the other users. If his/her own small-sized flying object or the small-sized flying object delivering his/her package is allowed by the other users to charge in return for allowing the other users to charge, it is convenient for both sides.

Accordingly, the ID and the positioning information of the own flying object are registered on the database of the predetermined server, and the positioning information of the nearest automatic opening/closing door can be searched by providing the own ID and referring to the database. The controller 24 preliminarily requests to register the unique ID assigned to the own flying object and the positional information. When needed, the controller 24 requests to reference the positional information of the nearest automatic opening/closing door by using the unique ID assigned to the own flying object.

Figure 14:
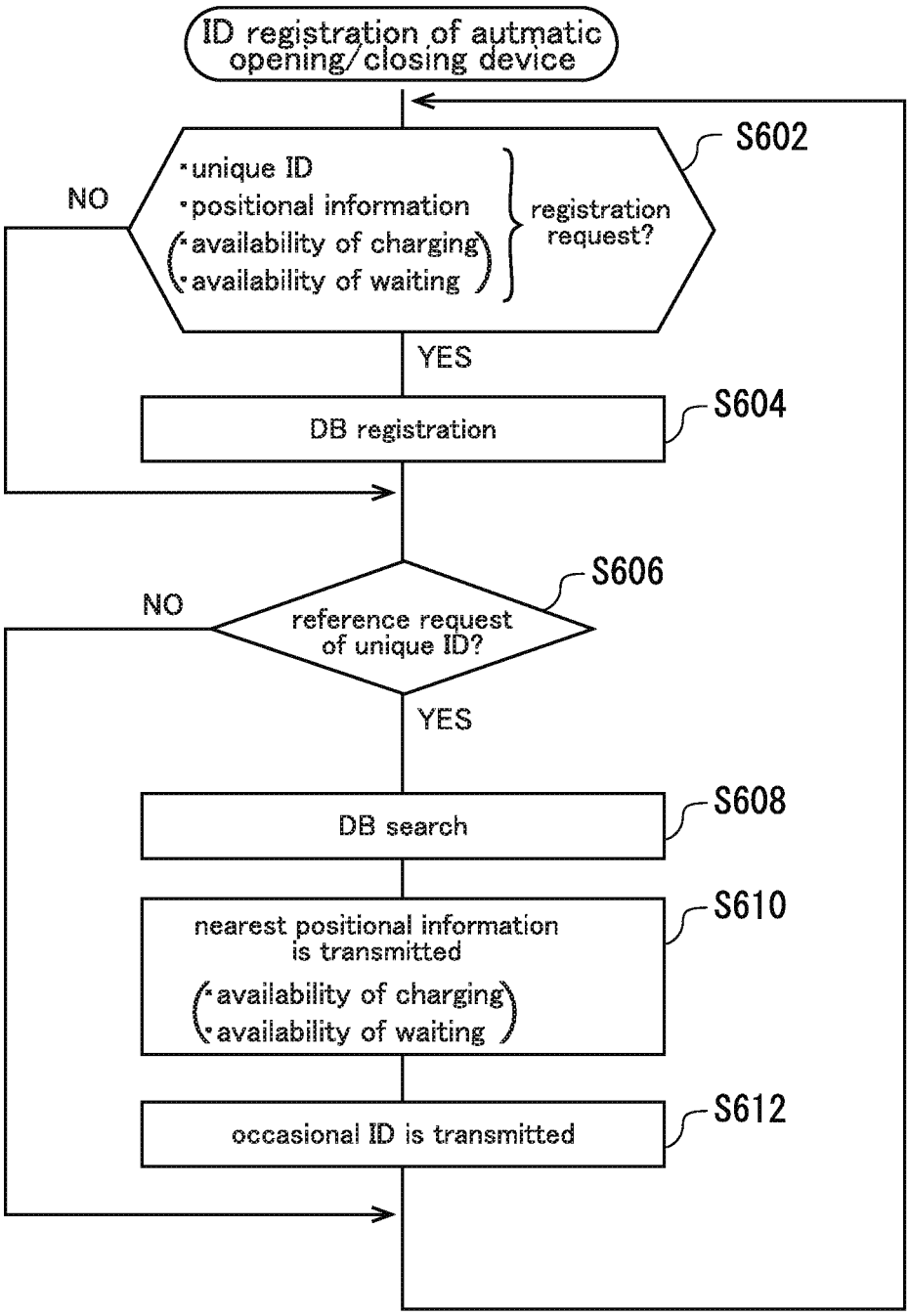
FIG. 14 is a flowchart for providing a system of a charging service.

FIG. 14 is a flowchart for providing a system of the charging service.

The server for the service judges the presence/absence of the request of registering the unique ID and the positional information in Step S602. If the request of registration exists, the server registers them on the database in Step S604. This service can be used not only for the request for charging but also for the request for temporarily waiting during bad weather. If the above described purposes are assumed, other items such as availability of charging and availability of waiting can be added to the database so as to be used for other purposes than the charging. The content of the database is gradually increased by repeating the above described processes.

On the other hand, when the flying object needs to receive the service, the reference request transmitted by the unique ID is transmitted to the server. Accordingly, the server for the service judges the presence/absence of the reference request of the unique ID and the positional information in Step S606. If the reference request exists, the server for the service searches them in the database in Step S608. Then, the searched nearest positional information is transmitted in Step S610. As explained above, when the service is used not only for the request for charging but also for the request for temporarily waiting, the reference result of other items such as availability of charging and availability of waiting is also transmitted. Note that a plurality of positional information can be provided sequentially from the near side to the far side without limited to the nearest positional information.

Since the flying object should temporarily land on, the server transmits the occasional identification code for allowing the landing to the small-sized flying object and the corresponding automatic opening/closing door in Step S612. The automatic opening/closing door that receives the occasional identification code opens/closes the shutter 13 and controls the charging power supply unit according to purposes such as the charging and the waiting. Namely, although it is necessary to guide the flying object to the landing pad 25, the shutter 13 is not necessarily opened/closed. About the guide system 20, it is possible to operate only the guidance system 20*a* and not to operate the safety system 20*b*.

As explained above, the automatic opening/closing window or door itself has the unique ID, and the detailed positional information such as an address, a latitude, a longitude and a height of the installation place is opened to the public by the database or the like or preliminarily transmitted to the drone came from outside. Because of this, autonomously flying drones can identify the location easily.

In addition, since the drone coming from outside can deliver the package on the stage, enough opening can be secured. Because of this, the size of the opening can be freely changed according to the package. For example, the opening can be fully opened or partly opened (e.g., half-opened). A sensor for detecting the drone when the drone approaches the window or door for passing through the window or door can be provided to open the window or door automatically.

In addition, the sensor can also have a function of closing the window or door after the drone left from the sill of the window or door. In particular, when the drone comes out from the indoor side to the outdoor side, the door can be opened if the sensor detects the drone even if the identification code (ID) is not confirmed.

On the other hand, it is preferred that the automatically opening/closing window or door is usually closed and opened only when the drone enters/exits to secure privacy and minimize the movement of air by the automatically opening/closing window or door. However, the window or door can be intentionally opened/closed by a human for ventilation and lighting.

Namely, the opening width of the door or window can be adjusted according to the size of the drone, the opening enough for the drone to pass thorough is secured, and inflow and outflow of unnecessary air and other unnecessary objects are minimized.

In addition, the size of the opening of the door or window can be specified enough for the drone to pass through but not enough for a person to pass through. Thus, crime prevention properties can be secured.

Note that the automatic opening/closing door of the present invention can be added to a part of the existing window or door and can be added to other places.

Furthermore, an operation power source can be supplied from the mounted battery to operate the door for a predetermined period. Thus, power source wirings are unnecessary. Even when power source is constantly supplied, the power source can be supplied for a predetermined period as a backup in case of a power failure or the like. Of course, the door can be operated by receiving a power from a commercial power supply.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the spirit and scope of the invention as defined in the appended claims.

What is claimed is:

1. An automatic opening/closing door having a predetermined openable opening to be opened to a desired degree for a flying object to which an identification code is set, the door comprising:

an identification code storage unit that stores a plurality of identification codes set to a plurality of flying objects which are allowed to pass the automatic opening/closing door by predetermined registering process;

an identification code recognition unit that recognizes the identification code of the flying object;

an identification code matching judgment unit, when the identification code recognition unit recognizes the identification code of the flying object, judges whether or not the recognized identification code matches with one of the stored identification codes;

an opening control unit that controls to open/close the opening according to a judgment result by the identification code matching judgment unit; and a guide unit that guides the flying object to the opening.

2. The automatic opening/closing door according to claim 1, wherein the identification code includes a first identification code not depending on distance and a second identification code for short distance, and the identification code storage unit, the identification code recognition unit and the identification code matching judgment unit use both the first identification code and second identification code.

3. The automatic opening/closing door according to claim 1, wherein the identification code includes a third identification code, and the identification code matching judgment unit judges the third identification code recognized by the identification code recognition unit to be matched with the stored identification code regardless of an actual matching of the stored identification code and the recognized identification code.

4. The automatic opening/closing door according to claim 1, wherein the identification code includes an occasional identification code, and the identification code matching judgment unit has a clocking unit so that the occasional identification code is valid only when the occasional identification code is within a valid period based on a clocking result of the clocking unit.

5. The automatic opening/closing door according to claim 1, the door further comprising:

a standby instruction unit that instructs the flying object to stand by; and a priority judgment unit that identifies a priority order of a plurality of flying objects, wherein the standby instruction unit instructs the plurality of flying objects to stand by except for the flying object having a highest priority order according to an identification result of the priority judgment unit, and the guide unit guides the flying object having the highest priority order.

6. The automatic opening/closing door according to claim 1, wherein the guide unit has a light guide unit having a plurality of light emitting elements, the light guide unit provides a positional information to the flying object by controlling independently the plurality of light emitting elements in a proximity mode, and the light guide unit provides the positional information by integrally controlling the plurality of light emitting elements in a far distance mode.

* * * * *